United States Patent [19]

Grove

[11] 3,952,879

[45] Apr. 27, 1976

[54] OVERLOAD CONTROL FOR LIFTING BOOM

[75] Inventor: John L. Grove, Greencastle, Pa.

[73] Assignee: Fulton Industries, Inc., McConnellsburg, Pa.

[22] Filed: Feb. 14, 1975

[21] Appl. No.: 550,073

[52] U.S. Cl. ..... 212/39 MS; 73/141 A; 214/762; 340/267 C

[51] Int. Cl.[2] ..... B66C 13/48

[58] Field of Search ..... 340/267 C; 73/141 A; 200/85 R; 212/39, 8 R, 144; 214/762

[56] References Cited

UNITED STATES PATENTS

| | | | |
|---|---|---|---|
| 2,030,529 | 2/1936 | Nash | 340/267 C |
| 2,319,299 | 5/1843 | Converse | 73/141 A |
| 2,988,040 | 6/1961 | Aitken | 340/267 C |
| 3,199,685 | 8/1965 | Bopp | 212/39 MS |
| 3,737,888 | 6/1973 | Cheze | 340/267 C |
| 3,756,423 | 9/1973 | Rathi | 340/267 C |

*Primary Examiner*—Robert J. Spar
*Assistant Examiner*—Lawrence J. Oresky

[57] ABSTRACT

A machine has a movable boom for lifting a load, and an overload sensing device mounted on the boom to sense boom deflection. The overload sensing device includes a rigid beam having one end secured to a vertical side plate of the boom only by anchors spaced widely apart, welded preferably on opposite sides of the centroid or neutral axis of the boom side plate. The beam has a free end, on which an adjustable contact plate is carried, to engage a switch adjustably carried on a mounting plate secured to the beam side plate.

19 Claims, 8 Drawing Figures

FIG. 1
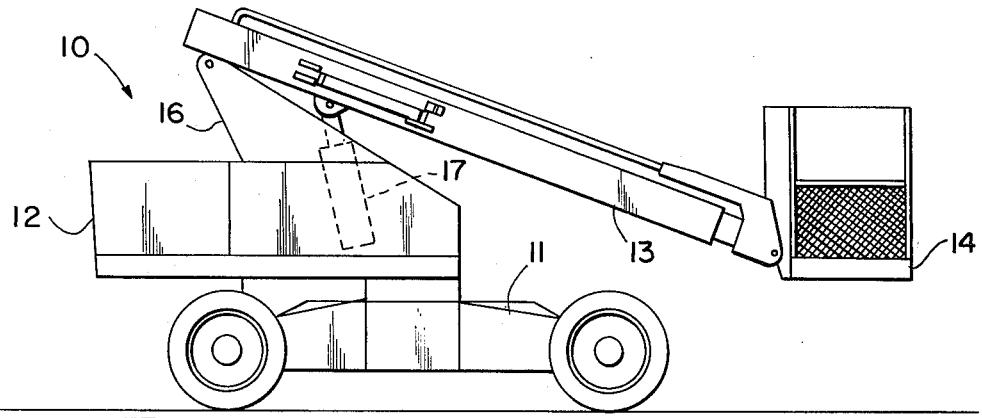
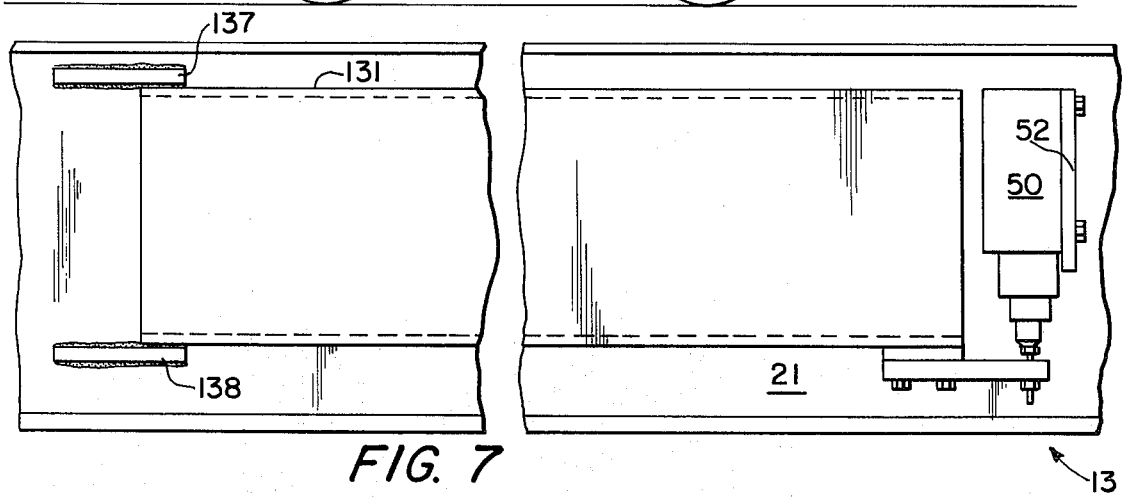
FIG. 7
FIG. 8
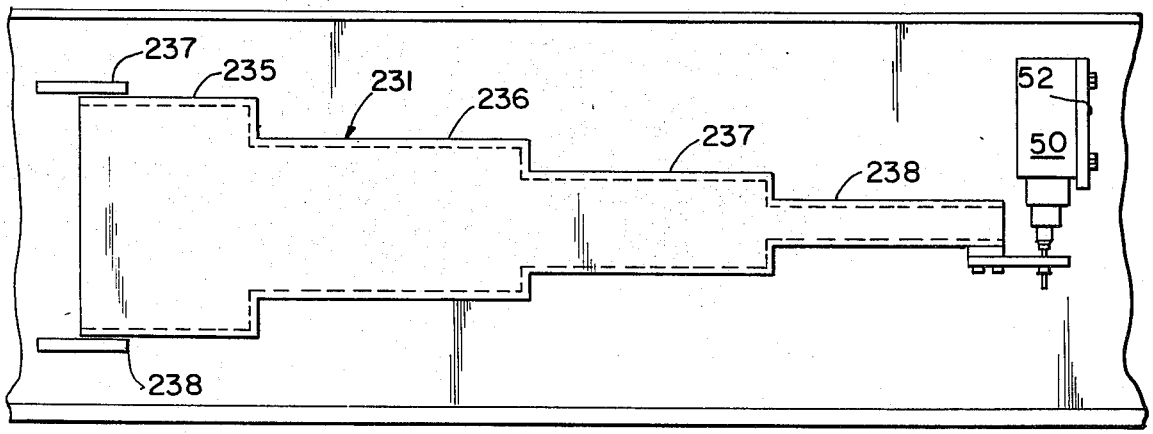

OVERLOAD CONTROL FOR LIFTING BOOM

BACKGROUND OF THE INVENTION

The present invention relates to a device for sensing overloads on a lifting boom, such as used in cranes, and aerial lift platforms.

Lifting booms are provided on various types of apparatus, such as cranes and aerial lift platforms, which latter are characterized by providing a platform or basket for one or more workmen. It has been recognized that these lifting booms may be overloaded, due to a combination of weight, boom angle and boom extension. Thus, it is known that the greater the weight, the greater the angle of the boom to vertical and the greater the extension of the boom, in the case of an extensible boom, the greater will be the bending moment. Such bending moments deflect or strain the boom, and where excessive, boom failure will occur. Typical instances of boom failure occur when a weight is swung outwardly by movement of the boom, either by downward luffing or by extension, or when a load which is too great is attempted to be lifted with the boom near the horizontal position.

A variety of devices have been proposed in order to prevent boom overload and failure. In some instances, cams and sensors have been provided, connected either to an alarm signal or to a control of the boom, such as the electrical circuitry in the case of a boom in which movement is controlled through switches and the like. These have not been as facile as desirable, often requiring multiple cams, and being subject to wear. Another proposal which has been made is to sense the pressure of the hydraulic fluid in a cylinder connected with the boom, the hydraulic fluid pressure being related to the load on the boom. This arrangement, although widely used, is not as sensitive as is desired: that is, when a boom, while being moved, approaches a position in which the pressure in the hydraulic cylinder becomes excessive, a substantial amount of back travel, either retraction of an extensible boom, or lifting, or both, are required in order to reduce the pressure of the hydraulic fluid sufficiently to enable continued movement of the boom. Yet another proposal in the prior art has utilized transducers, such as strain gauges, for sensing the strain of the material comprising the boom. These arrangements, however, required a significant amount of electrical circuitry, thus adding to the cost, and requiring sophisticated and relatively expensive sensing equipment to sense the changes in the electrical characteristics of the strain gauge and/or transducers resulting from the strain or deflection of the boom material.

There has also been provided, in addition, an overload safety device for material handling mechanism which provided for the detection of an approaching overload condition by sensing deflection in a stressed member, and then automatically interrupting circuitry controlling the means causing the deflection-increasing movement of the load, while at the same time permitting actuation of means for deflection-decreasing movements. In this construction, a lever arm in the form of a hollow tube was welded directly to two lever arm mounts which were in turn welded to the boom, to either the top or side thereof. The spacing of the mounts was the width of the lever arm-beam, which width was apparently that which was required to avoid deflection of the lever arm-beam and consequently malfunction of the device. A switch bracket was pivotally connected to the outer end of the lever arm, being biased by a spring, and carrying at its outer end one or more micro-switches. A bracket welded to the boom carried adjustable set screws, in juxtaposition with the switch or switches. When the boom deflected, there was relative movement between the micro-switches carried on the bracket and lever arm, on the one hand, and the set screw and bracket on the other hand, resulting an actuation of the micro-switch or micro-switches, which thereupon changed the circuitry and prevented further movement toward the overload condition. While this construction avoids many of the noted deficiencies of other constructions, it was not as sensitive as desirable, appears to result in vibration of the lever arm and/or switch bracket, and further, by mounting the micro-switches on the lever arm and switch bracket, with an intervening spring, seems not to provide a construction which would give the same results on repeated usage. Otherwise stated, this construction may well produce results which vary from time to time, under the same conditions. Further, although a weather shield was disclosed on this construction, there could result a failure if the shield leaked, and the spring between the lever arm and the switch bracket rusted.

SUMMARY OF THE INVENTION

The overload control of the present invention provides a beam having one end secured to a lifting boom, and extending along the boom, with a micro-switch secured to the boom adjacent the free end of the beam. Where the boom is of hollow, rectangular cross section with vertical side plates, when the boom is stressed by the load, it is strained, and deflects the top plate and upper portions of the side plates being placed under tension and the bottom plate and lower portions of the side plates being placed under compression. Thus, the upper portion of the boom somewhat elongates, and the lower portion of the boom somewhat compresses, there being a centroid or neutral axis which is neither elongated nor compressed, and is under neither tension nor compression. The beam is secured to a side plate in such a manner that it tends to twist or rotate relative to the side plate, thereby achieving greater sensitivity due to enhanced movement of its free end. This is achieved by securing one end of the beam to the side, or side plate, of the boom by a pair of anchor plates which are spaced apart transversely of the boom longitudinal axis a large distance, specifically a distance greater than the depth of a beam required to prevent significant beam deflection. Preferably, a transverse spacer plate supports the beam, being of greater depth than the beam, and having the anchor plates secured to it adjacent its margins. Alternatively, the fixed end of the beam, or the entire beam, may be of oversize depth, with the anchor plates secured directly to it: by "oversize" is meant a depth substantially greater than that required for the beam to function properly, considering conventional factors such as material, shape, length of the beam and the load imposed on it. The anchor plates preferably extend parallel to the beam axis, one on either side of the centroid or neutral axis of the boom. The beam is secured to the anchor plates only and is not otherwise connected to the boom. The beam carried an engagement plate at its free end, mounted for longitudinal adjustment: the engagement plate carries a screw for engagement with the plunger of the micro-switch, which is axially adjustable. In addition, the micro-switch is mounted on a plate for adjustable movement toward and away from the boom side plate.

Among the objects of the present invention are to provide an overload control device for a lifting boom which does not require complex circuitry, but which is of improved sensitivity. Another object of the present invention is to provide such a device wherein the beam is not subject to vibration as the boom is moved, and the weight or its position varied, and a further object is the provision of such a device which will repeatedly function in the same manner. Yet another object of the present invention is the provision of an overload control which will function satisfactorily over a long period of use, even under adverse atmospheric conditions. Still another object of the present invention is to provide an overload control device which will enable construction thereof with the boom, as the boom moves through the normal assembly operations.

BRIEF DESCRIPTION OF THE DRAWING

FIG. 1 is an elevational view of a machine with a lifting boom and an overload control in accordance with the present invention.

FIG. 7 is a view similar to FIG. 2, showing an alternate embodiment of the invention.

FIG. 8 shows another embodiment of the invention.

DESCRIPTION OF THE PREFERRED EMBODIMENT

Figure 2:
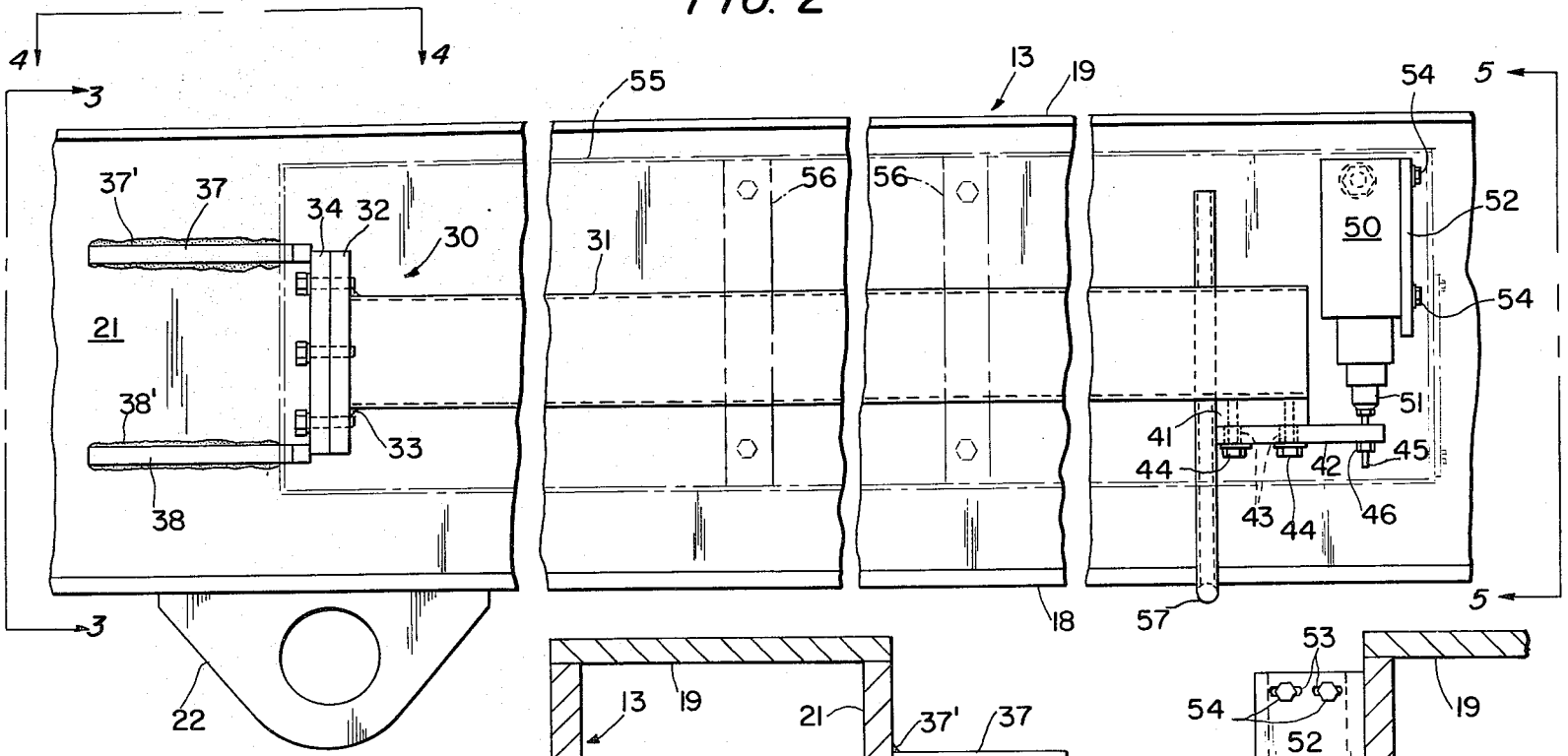
FIG. 2 is an elevational view of a portion of the boom, and the overload control device of FIG. 1.

Referring now to the drawings, wherein like or corresponding reference numerals are used for like or corresponding parts throughout the several views, there is shown in FIG. 1, a machine 10 which includes a wheeled chassis 11, a rotatable upper works 12, and a boom 13. On the outer end of the boom 13 there is shown a workman's platform 14. The boom 13 is shown is telescopic, but may not be, and may lift a load other than a workman's platform, such as is the case in connection with a crane. The upper works 12 includes a boom support 16 to which the boom is pivotally connected at its rear end, there being provided, also, a lifting cylinder 17 for luffing, i.e., raising and lowering, the boom 13 about the pivotal connection with the support 16. The boom 13 is preferably telescopic, and, typically, is of hollow, rectangular construction, although it will be understood that the lifting boom 13 need not be either of this construction or telescopic. On the side of the lifting boom 13 is the overload control and sensing device of the present invention. As will be understood, when the lifting boom 13 is subjected to stress of a load, usually carried at or near its outer end, it will be strained by that load and will deflect in an arcuate manner.

Referring now to FIG. 2, there may be seen the lifting boom 13 including bottom plate 18, top plate 19 and side plate 21: fixed to the bottom plate 18 is a trunnion 22 which serves to pivotally connect the lift cylinder 17 to the boom 13.

The overload control device 30 includes a beam 31, which is preferably of hollow rectangular construction, and which extends along the boom 13, the axis of beam 31 in the unstressed condition of boom 13 being substantially parallel to the axis of boom 13. At its left or fixed end, the beam 31 is secured to a plate 32, as by a peripheral weld 33. The plate 32 is in a plane substantially transverse to the axis of beam 31 and boom 13, and is secured to a plate 34 by bolts 36. The plate 34 is secured to a pair of anchor plates 37 and 38, which latter are secured to the side plate 21 by welds 37′ and 38′.

Figure 3:
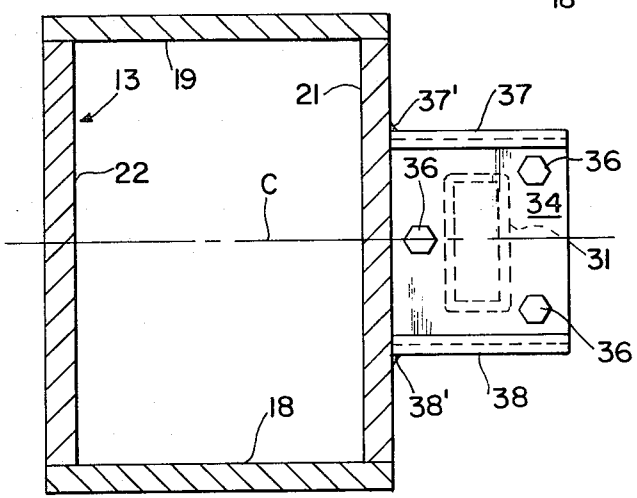
FIG. 3 is a cross sectional view taken on the line 3—3 of FIG. 2.

The anchor plates 37 and 38 may also be seen in FIG. 3. The anchor plates 37 and 38 are of generally triangular configuration, in the preferred embodiment, as may be seen from FIG. 4. The hollow rectangular shape beam 31 may be seen in FIG. 3, as well as the hollow rectangular shape of the boom 13, including the side plate 22, opposite side plate 21. Also shown on FIG. 3 is a line C which is indicative of the centroid or neutral axis of the boom: as is known, the stress resisting material of the boom 13 which is above the centroid C is under tension, and tends to elongate, while the stress resisting material of boom 13 below the centroid C is under compression, and tends to be compressed. It will further be noted from FIG. 3 that the anchor plate 37 is substantially above the centroid C, while the anchor plate is below, on the opposite side of the centroid C from the anchor plate 37.

Referring again to FIG. 2, at the right hand or free end of the beam 31 there is welded or otherwise secured an attachment plate 41, to which is secured an engagement plate 42. Engagement plate 42 is provided with slots 43, which extend in the direction generally parallel to the axis of beam 31, and is secured to the attachment plate 41 by bolts 44. A linearly extending screw 45 is threaded into the engagement plate 42, locked into position by a lock nut 46, and serving to engage the plunger 51 of a micro-switch 50.

Figure 5:
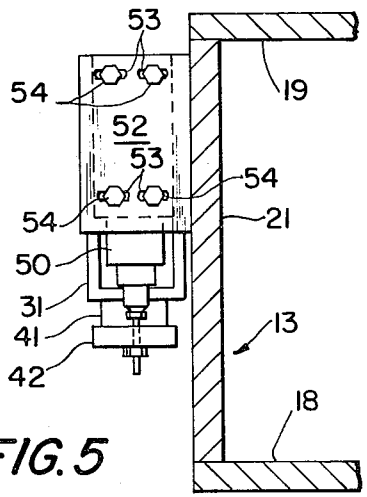
FIG. 5 is a cross sectional view, with parts broken away, taken on the line 5—5 of FIG. 2.

Referring to FIGS. 2 and 5, there is secured, as by welding, to the side plate 21 a switch support plate 52, provided with four transversely extending slots 53. As is apparent, the plate 52 extends substantially transversely to the axis of lifting boom 13, and bolts 54 extend through these slots 53, securing the micro-switch 50 to the plate 52.

Figure 4:
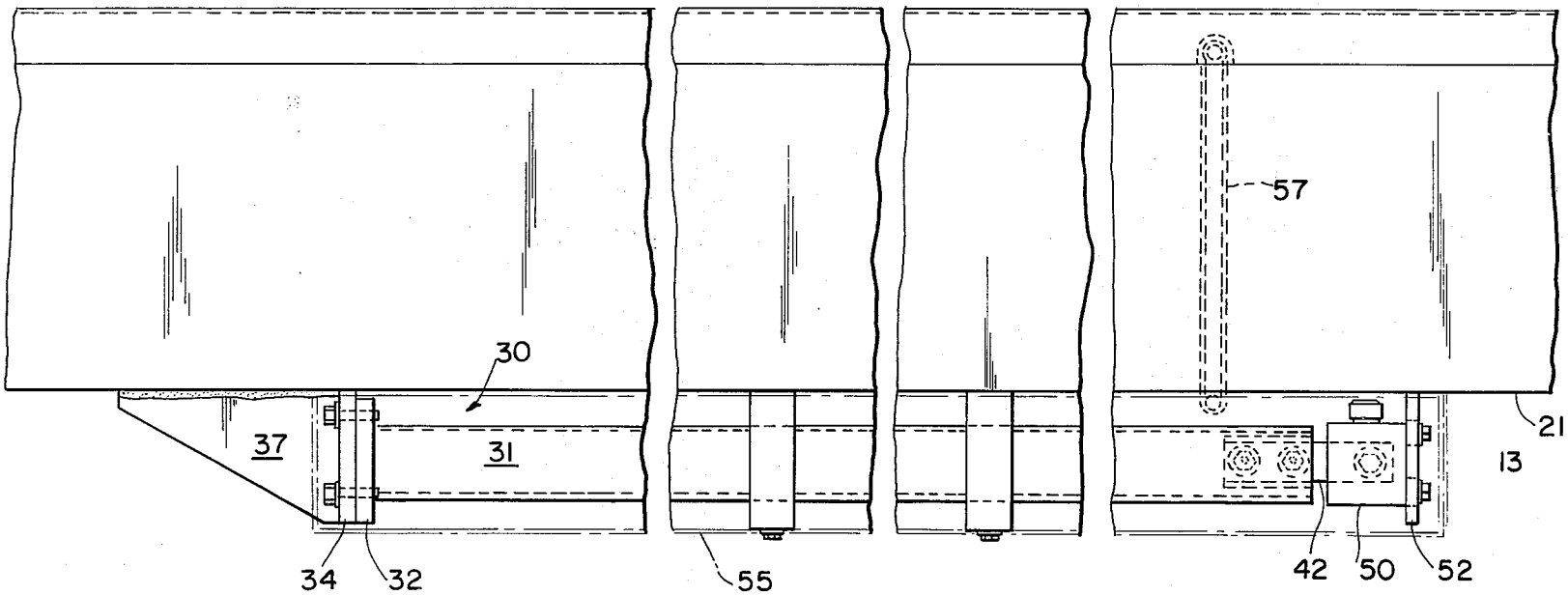
FIG. 4 is a view taken on the line 4—4 of FIG. 2.

FIG. 4 discloses a plan view, including the anchor plate 37, which is of a generally triangular configuration, there being shown secured to it the spacer plate 34, which is also secured to the other anchor plate 38. There are also shown the plate 32 which is releasably connected to the spacer plate 34 and is welded to the beam 31. At its free end, there may be seen attached to the beam 31 the engagement plate 42, which extends beneath the micro-switch 50, which latter is carried by the support plate 52 that is welded to the side plate 21 of the boom 13, extending generally transversely to the side plate 21, and to the axis of boom 13. There is shown in FIGS. 2 and 4 a removable cover 55, shown in phantom lines, which completely encloses the beam 31 and the micro-switch 50, thereby protecting them from the elements, particularly rain and snow. In the event that water does gain access to the sensing device 30, it is not likely to damage it or interfere with its operation, since the plunger 51 of microswitch 50 extends downwardly and thereby there is avoided the possibility that water will enter the housing of the micro-switch through the passage thereof in which the plunger 51 moves. The cover 55 may be held in position by suitable securing devices, such as straps 56. A conduit 57 is provided for guarding the electrical conductors which extend to the microswitch 50.

During assembly operations, the lifting boom 13 is fabricated by the welding together of the various plates which form it. Consequently, in the welding area of the assembly plant, the anchor plates 37 and 38 may be readily welded to the boom side 21, and the plate 34 welded to the anchor plates 37 and 38. In addition, the plate 52 may be welded to the side 21. Thereafter, during further construction and assembly of the machine 10, the beam 31 and plate 32 are secured together by the bolts 36, and the micro-switch 50 secured to the plate 52 by bolts 54. Thereafter, due to the above noted construction including the slots 43 and 53, and the threaded engagement of screw 45 adjustments in position are effected so as substantially to line up the linearly extending screw 45 with the plunger 51 of micro-switch 20. In addition, the beam 31, even though secured to the side 21 of boom 13 only by the welding of the plates 37 and 38 to the side 21, the welding of the plate 34 to the anchor plates 37 and 38 and the connection together of the plates 32 and 34, will be relatively free of vibration, even in highly stressed conditions of the lifting boom 13.

Figure 6:
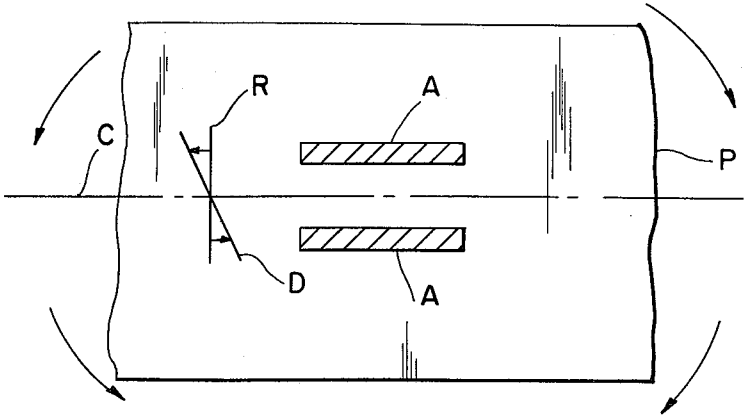
FIG. 6 is a diagram illustrating certain aspects of the invention.

Referring now to FIG. 6, there is shown a plate P which functions as a beam, being loaded at one end and supported at the other end: thus, the plate P is analogous to the boom 13 and to the side plate 21 thereof. The loading of the plate P is indicated by the arrows, and thus the portion of the plate P above the centroid C is in tension, while the bottom portion of the plate P is in compression. Shown on the plate P are a pair of areas A, which correspond to the areas of anchor plates 37 and 38, where welded to the side plate 21. At the left of the anchor areas A there is a displacement diagram which includes a vertical reference line R and a displacement line D. An arrow extends toward the left, from the reference line R and intersects with the displacement line D, which arrow is at the same distance above the centroid C as the upper area A. A similar arrow is provided for the lower area A, the arrow extending, however, to the right. For a given load in a particular plate P, it will be seen that the further apart the anchor areas A are placed, the greater will be their relative movement, due to their being anchored on portions of the plate P which exhibit some movement or deflection, as indicated. Thus, relating FIG. 6 to, for example, FIG. 2, it will follow that the anchor plates 37 and 38 move in opposite directions, when the boom 13 is placed under load, and thereby cause the the beam 31 to move in a generally counter-clockwise manner, due to the action of the anchor plates 37 and 38 moving with the parts of the side plate 21 to which they are secured. As will be appreciated, the wider apart the anchor plates 37 and 38, the greater will be this counter-clockwise movement of the beam 21, and therefore there will result a greater sensitivity of the sensor device 30. Preferably, ther anchor areas A and the corresponding securing of the anchor plates 37 and 38 are on opposite sides of the centroid C.

Referring again to FIG. 2, it will be seen that the anchor plates 37 and 38 are secured to the marginal portions of the spacer plate 34, which are substantially wider apart than the top and bottom margins of the beam 31, which define the depth of beam 31. Beam 31 is, of course, of a cross sectional shape, material and length and carries a load at its free end when it engages the micro-switch 50: these factors are taken into consideration in calculating the depth of beam 31, which is provided to accommodate the noted load, without deflection such as will interfere with its function. Thus, in a practical embodiment, the beam 31 has a depth of approximately three inches, while the spacing between the center line of the anchor plates is approximately twice that, being five and one-half inches. Thus, the spacing of the anchor plates 37 and 38 is substantially greater than the depth required for the beam 31 in order to prevent significant deflection of it.

Referring now to FIG. 7, there is shown an alternate embodiment of the present invention, wherein there is provided on the side plate 21 of the beam 13 a pair of anchor plates 137 and 138, joined to the beam 131 by being welded directly thereto. The beam 131 has a substantially greater depth than that required to prevent significant deflection of it, and therefore may be said to be an "oversize" beam. As will be seen from FIG. 7, the beam 131 is of substantially uniform cross section from its anchored or secured left end to its free right end, adjacent the micro-switch 50.

In FIG. 8 there is shown still another embodiment of the present invention, in which the beam 231 is of linearly stepped configuration, with its left end secured to anchor plates 237 and 238. The end portion 235 has a substantially greater depth than is required for the strength and load considerations of the boom, although the succeeding sections 236, 237 and 238, being of successively lesser depth, may be of either the proper depth from the engineering standpoint or oversize.

While there has been illustrated beams which are of generally hollow, rectangular cross sectional configuration, as will be appreciated, other shapes of beams may be used. The beam, in accordance with the present invention, however, will be either of the appropriate size, particularly depth, for the loads imposed, and a spacer plate used to provide increased spacing between the anchor plates, or alternatively, the beam may be made oversize in whole or in part, specifically as related to depth, in order to provide the greater spacing of the anchor plates.

While the sensing element for movement of the beam relative to the boom has been herein described as a micro-switch, in the preferred embodiment, it will be understood that other sensing devices, known in the prior art could be used, and could provide an indication of the load on the boom. Thus, a graduated read-out could be utilized, based on the teachings of Nash U.S. Pat. No. 2,030,529, or Rathi U.S. Pat. No. 3,756,423.

There has been provided a device for sensing strain or deflection of a boom, which has greater sensitivity, while requiring minimal retraction movement or load-decreasing movement, in order to restore the circuitry to normal operating condition. Further, the herein disclosed overload sensing device is constructed so as to avoid undue vibration of the beam thereof as the boom is moved, and the load on the boom is varied. The herein disclosed apparatus functions well, with the ability to repeat its control function in a uniform manner over many applications. The herein disclosed overload sensing and control device functions satisfactorily over a long period of use, and while it is provided with a shield against the elements, it is not liable to become defective even if subject to, for instance, rain or snow. The herein disclosed device may be facilely constructed with the boom, certain parts being welded when the boom is being fabricated in a welding area of an assembly plant, and other parts being assembled with bolts and screws and the like, where such operations are performed in connection with other parts of the boom in other areas of an assembly plant.

It will be obvious to those skilled in the art that various changes may be made without departing from the spirit of the invention, and therefore the invention is not limited to what is shown in the drawings and described in the specification but only as indicated in the appended claims.

I claim:

1. In a machine having a movable boom for lifting a load, the boom being thereby subjected to bending stresses which strain the boom, a beam extending along and generally parallel to a side of said boom;

means securing one end only of said beam to the side of said boom for twisting of said one end of said beam upon the imposition of bending stresses on said boom, said securing means comprising a pair of spaced anchor means vertically spaced when the boom axis is horizontal secured to said boom side and being spaced apart a substantially greater distance than the depth required for a beam in order to prevent significant deflection thereof, and means spaced from said anchor means for sensing movement of said beam relative to said boom as said boom is stressed toward an overload condition, whereby the movement of said beam relative to said boom is enhanced by the twisting of said end thereof to provide greater sensitivity of measurement of boom strain.

2. The apparatus of claim 1, said securing means comprising a plate substantially perpendicular to the boom longitudinal axis, means connecting said one end of said beam to said plate, said plate having a vertical extent greater than the depth of said beam, and means connecting said anchor means to said plate, said anchor means being spaced apart a substantially greater distance than said depth of said beam.

3. The apparatus of claim 2, wherein said anchor means are welded to said boom and to said plate, and wherein said means connecting said one end of said beam to said plate comprises releasable means.

4. The apparatus of claim 1, wherein said beam has a depth greater than that required in order to prevent significant deflection thereof.

5. The apparatus of claim 1, said sensing means comprising a switch and means mounting said switch adjacent the opposite end of said beam for actuation thereof upon excessive strain of said boom.

6. The apparatus of claim 5, said last mentioned means comprising a plate welded to the boom and extending laterally thereof, and means releasably securing said switch to said plate.

7. The apparatus of claim 5, said beam having engagement plate means releasably secured to the free end thereof.

8. The apparatus of claim 5, said beam having engagement plate means longitudinally adjustably secured to the free end thereof in a plane generally parallel to the neutral axis.

9. The apparatus of claim 8, said engagement plate means comprising a linear engagement element transverse to said engagement plate means.

10. The apparatus of claim 9, said switch comprising a housing and a plunger extending downwardly from said housing toward said linear engagement element.

11. In combination with a movable load supporting boom having an unstressed neutral axis under load, means for sensing excess strain of said boom comprising:

a beam, means for securing one end of said beam to said boom with said beam extending along said boom and for causing twisting of the beam relative to said neutral axis at said one end of said beam upon loading of said boom comprising anchor means securing said beam to said boom spaced apart a substantially greater distance than the depth required for a beam in order to prevent significant deflection thereof, engagement means on said beam remote from said securing means, switch means, and means for securing said switch means to said boom adjacent said engagement means for actuation thereof upon excessive strain of said boom.

12. The combination of claim 11, wherein said means securing said beam to said boom comprises first anchor means welded to said boom and second means releasably connecting said first anchor means and said beam.

13. The combination of claim 11, wherein said means for securing said switch means to said boom comprises means for laterally adjusting said switch means.

14. The combination of claim 11, wherein said engagement means comprises an engagement plate and a linear engagement element transverse to said engagement plate, and means for adjusting said element linearly.

15. The combination of claim 14, wherein said means for securing said switch means to said boom comprises means for laterally adjusting said switch means.

16. The combination of claim 15, wherein said means securing said beam to said boom comprises anchor means secured to said boom on opposite sides of the neutral axis thereof.

17. The combination of claim 11, wherein said means securing said beam to said boom comprises anchor means secured to said boom on opposite sides of the neutral axis thereof.

18. The combination of claim 12, said first anchor means comprising anchor plate means vertically spaced apart when said boom axis is horizontal.

19. In a structure having a load-lifting boom subjected to variable bending stresses and apparatus operatively connected to said load-lifting boom to sense the bending strain thereof when said boom is stressed, said sensing apparatus comprising a beam supported adjacent a side of said boom and means for sensing the relative movement of said beam and said boom upon stressing of said boom, the improvement comprising plural anchor means vertically spaced when the boom is horizontal a substantially greater distance than the depth required for a beam in order to prevent significant deflection thereof, for securing said one end of said beam to said side of said boom for twisting of said one end of said beam relative to the boom upon the imposition of bending stresses on said boom, whereby to provide enhanced movement of said beam relative to said boom and thus greater sensitivity of measurement of the bending strain of said boom.

* * * * *